US005469802A

United States Patent [19]

Ivicevic

[11] Patent Number: 5,469,802

[45] Date of Patent: Nov. 28, 1995

[54] BOAT ANCHOR

[76] Inventor: Dragomir Ivicevic, 575 Main St., Ste. 1514, New York, N.Y. 10044

[21] Appl. No.: 263,788

[22] Filed: Jun. 22, 1994

[51] Int. Cl.[6] ..... B63B 21/32

[52] U.S. Cl. ..... 114/301

[58] Field of Search ..... 114/294, 297, 114/300, 301, 310

[56] References Cited

U.S. PATENT DOCUMENTS

| | | | |
|---|---|---|---|
| 242,958 | 6/1881 | Moule | 114/301 |
| 533,668 | 2/1895 | Reeves | 114/300 |
| 1,858,347 | 5/1932 | Swift | 114/300 |
| 4,827,863 | 5/1989 | Scholz et al. | 114/301 |

OTHER PUBLICATIONS

B. Stearns, "Deep Thoughts", *Boating*, Aug. 1993.
Russ Fee, "New Anchor Swings Through 360° Without Losing its Grips", *National Fisherman*, Sep. 1992, vol. 73, No. 5.
The New Universal Anchor, Hans C–Anchor pamphlet.
The Rule Group, "1994 Marine Products Catalog", pp. 9–12.
Simpson Lawrence, "Quality Marine Equipment", pp. 13–18.
BOAT/U.S. Price Guide, "1993 Annual Equipment Catalog", pp. 95–98.
BOAT/U.S. Price Guide, "1994 Annual Equipment Catalog", pp. 141–154.
Peter Bruce, "The Bruce Anchor Philosophy", pp. 1–11.
Hans C. Anchor's Universal Anchor, Marine Business Journal.
Florida Sportsman, Dec. 1991, "In The Know" Gear for the Sportsman.
SOUNDINGS, Feb. 1992, New Products—Innovative Anchoring Technology, Hans C. Anchor, Inc.
Southern Boating, Mar. 1992, "Innovative Anchor".
BOATING, Mar. 1992, "Moor News".
SAILING, Feb. 1992, "Gear Guide".
TRAILER BOATS, vol. 21, No. 4, Apr. 1992, "Universal Anchor".
CRUISING WORLD, Mar. 1992, "Universal Anchor".

*Primary Examiner*—Stephen Avila

[57] ABSTRACT

A boat anchor includes a short arcuate shank having transversely extending plow-type flukes at one end and transversely extending ears at the other end. A metal cable connects to the rear end where the plow flukes are positioned, and extends to a constraining guide located on the shank between the flukes and the ears. The cable then extends through a longitudinally non-constraining front guide on the shank end near the ears of the anchor. The cable partially wraps around the shank in its path between the intermediate guide and the front guide. For use on rocky bottoms, the cable is disengaged from the intermediate guide. By attaching the cable to the shank adjacent to the plow flukes, pulling stresses from the cable are applied to the intermediate constraint and fluked end of the anchor. The shank between the ears and the intermediate constraint is not fully stressed and those portions can be made thinner and lighter without affecting the holding power of the anchor. When the anchor is initially dragged, a working surface of the ears engages the bottom and causes the anchor to rotate into a preferred position from which the plow flukes dig their way rapidly into the sea bottom. The ears also dig their way into the sea bottom such that the anchor becomes completely buried. Thereby, very high holding efficiency and low bending risk are achieved with an anchor having a light-weight construction.

34 Claims, 6 Drawing Sheets

BOAT ANCHOR

BACKGROUND OF THE INVENTION

This invention relates to boat anchors and more particularly to highly efficient anchors having a low weight to holding power ratio.

Anchors typically include a plow portion having laterally extending flukes, which are coupled to an elongated shank that is fixed to the plow portion or hinged thereto. The free end of the shank is connected, in use, to a chain and then generally to a rope that connects to the boat. The anchor must be useful both for anchoring in sandy, muddy, clay and gravel bottoms as well as against a rocky bottom or a bottom covered with grass or other undergrowth. Hinged shanks present problems of corrosion and poor operation at the hinge as well as a potential hazard to the mariner who handles and works with the anchor. An anchor of the hinged type is offered by Simpson Lawrence USA, Inc., Bradentown, Fla., U.S.A., and a one-piece anchor is provided by Bruce International Limited, Onchan, Isle of Man, Great Britain. The anchor by Bruce has a shank that includes substantially a right angle bend. Both of these products are generally well accepted in boating circles.

In all of the prior art anchors, the chain attaches at the shank end most remote from the plow flukes. Thus, the entire length of the shank must be sufficiently thick to withstand stresses that tend to bend the shank when the anchor is being dragged into its initial holding position. Even with a heavy shank construction, when anchoring on a rocky bottom, the plow flukes may catch on a rock and cause bending around the rock of the elongated shank. A further difficulty with the long shank is that when anchoring in sand or mud, a considerable drag distance is required before the plow flukes penetrate deeply enough into the bottom to restrain the boat. Weight of the anchor for a given size and holding power is also a very important convenience factor in using and handling an anchor and in maintaining it on the boat when not in use.

Accordingly, it is desirable that the greatest holding power be provided with an anchor having low weight and a compact non-deforming structure. A long shank works against these objectives in that extra strength is necessary to resist bending, especially when anchoring on a rocky bottom, as discussed above.

What is needed is a boat anchor that has a low weight to holding power ratio, is of small size, simple construction and suited for use on all types of sea bottoms, whether sandy, rocky or overgrown with underwater foliage.

SUMMARY OF THE INVENTION

Accordingly, it is an object of the invention to provide an improved anchor that has low weight relative to its holding power and size and is suitable for use on all types of sea bottoms.

Another object of the invention is to provide an improved anchor that is of a one-piece construction without hinges or moving parts.

Yet another object of the invention is to provide an improved anchor that provides good holding and easy release from the sea bottom and is easily stowed on the boat.

Still another object of the invention is to provide an improved anchor having a short shank so as to reduce risks of bending over rocks and damage to the anchor.

Yet another object of the invention is to provide an improved anchor that readily disengages from underwater rocks when the anchor is to be raised.

In accordance with the invention, a boat anchor includes a short arcuate shank having plow-type flukes at one end and transversely extending paddle or shovel-shaped ears at the other end of the shank. A cable, preferably of metal, connects to the rear end of the anchor where the plow flukes are positioned, and extends to a constraining guide located on the shank between the flukes and the ears. The cable then extends through a longitudinally non-constraining front guide on the shank near the ears of the anchor. The cable partially wraps around the shank in its path between the intermediate guide and the front guide. For use on rocky bottoms, the cable is disengaged from the intermediate guide.

By attaching the cable at the rear of the anchor, i.e., to the shank adjacent the plow flukes, pulling stresses from the cable and rope are applied to the intermediate and far (rear) end of the anchor. The shank portion between the ears and the intermediate constraint is not fully stressed and those portions can be made thinner and lighter without affecting the holding power of the anchor.

When the anchor is dropped and initially dragged, the ears, because of their enlarged area and paddle shape, engage the bottom and by their resistance to dragging cause the anchor to rotate into a preferred position from which the plow flukes dig their way rapidly into the bottom, if the bottom is of sand, clay or mud, etc. The ears also dig their way into the sea bottom such that both the plow flukes and the ears become completely buried. Thereby, very high holding efficiency is achieved with an anchor having a light weight shank.

The arcuate shape of the shank enables the plow flukes to readily engage rocky bottom surfaces and also allows for rotation of the anchor when it is being lifted from a position holding against a rocky surface. When raised from the bottom by means of a bow roller, the anchor orients itself so that the plow flukes cradle the boat's bow and thereby a compact, snug, storage arrangement is provided. There are no moving parts or hinges on the anchor such that malfunctions due to corrosion and the like, and hazards to personnel are minimized. The anchor is preferably one piece.

The invention accordingly comprises the features of construction, combinations of elements and arrangements of parts, which will be exemplified in the constructions hereinafter set forth, and the scope of the invention will be indicated in the claims.

BRIEF DESCRIPTION OF THE DRAWINGS

For a fuller understanding of the invention, reference is had to the following description taken in connection with the accompanying drawings, in which.

DESCRIPTION OF THE PREFERRED EMBODIMENT

Figure 6:
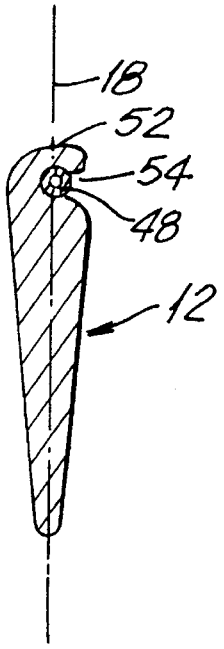
FIG. 6 is a sectional view taken along the line 6—6 of FIG. 4.

With reference to the figures, the anchor 10 in accordance with the invention includes an arcuate shank 12 of slender cross-section (FIG. 6). A pair of paddle-shaped ears 14, looking somewhat like a whale's tail, extend transversely from the shank 12 at the front end 16 thereof, substantially at right angles to the longitudinal axis 18 of the shank cross-section.

Figure 11:
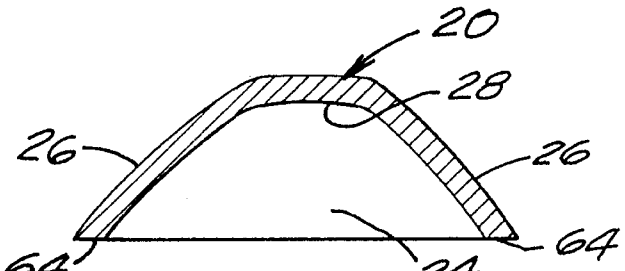
FIG. 11 is a sectional view taken along the line 11—11 of FIG. 2*b*.
Figure 9:
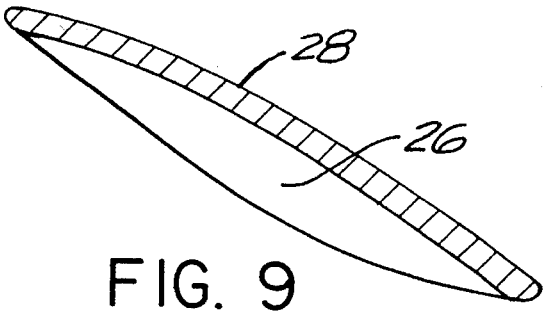
FIG. 9 is a sectional view taken along the line 9—9 of FIG. 2*b.

A pair of plow flukes 20 extend transversely from the rear end 22 of the shank 12, i.e., generally at a right angle to the axis 18 of the shank. The plow flukes 20 together form a generally heart-shaped, butterfly-wing-type arrangement (FIGS. 1–3) and are larger than the ears 14. The rounded point 24 of the heart-shape faces toward the ears 14, i.e., toward the cable and rope that will pull on the anchor, as explained more fully hereinafter. The rear lobes 26 of the heart-shaped flukes are rounded and the flukes 20 have an arcuate cross-section (FIGS. 9, 11). The plow flukes 20 are symmetrically mounted, along the convex surface of the flukes 20, to the rear end 22 of the shank 12. The concave surface 28 between the lobes 26 is generally smooth and continuous, a gentle V-shape (FIG. 11).

A concave working surface 30 extends between the ear lobes 32, and the opposite convex surface of the ears 14 connects symmetrically to the shank 12 at the front end 16. The extended area paddle-shapes of the ear lobes are important in providing resistance when pulling on the anchor after the anchor has been dropped and settles to the sea bottom. An imaginary line 34 extended between the extremities 36 on the fluke lobes 26 is generally parallel to an imaginary line 38 extended between the extremities 40 of the ear lobes 32.

The arcuate shank 12 lies generally in a plane. The angle 42 of arc 43 in the shank 12 is approximately 90 degrees from the point of attachment to the flukes 20 to the attachment point of the ears 14, although this line of connection that defines the concave edge 43 of the shank 12 need not be circular.

Figure 7:
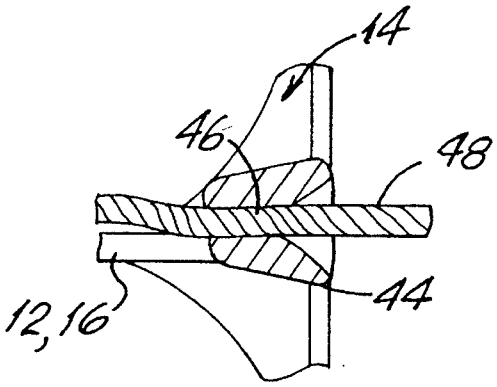
FIG. 7 is a sectional view taken along the line 7—7 of FIG. 4.

A circular guide 44 is attached to the shank 12 on the edge 43 at the front end 16 and provides a circular opening 46 through which a cable 48 can freely pass with a running or sliding fit. The opening 46 flares outwardly (FIG. 7) so that the cable 48 can enter at any angle relative to the axis of the opening 46 without damage to the outer surface of the cable 48. The working surface 30 of the ears 14 lies generally between a centerline 47 of the opening 46 and the imaginary line 38 through the extremities 40 of the ears 14. The centerline 47 and the line 38 are generally parallel.

A constraining guide 50 is located on the convex edge 49 of the shank 12, approximately mid-way between the plow flukes 20 and the ears 14. As illustrated in FIG. 6, the cable 48 is snugly retained between a leaf 52 that extends from the main cross-section of the shank 12 and folds over to form a restricted opening 54 wherein the cable 48 may be inserted and releasibly retained with a light forced fit.

A lug 56 on the convex edge 49 of the shank 12 proximate the rear end 22 provides for fixed attachment of the end 58 of the cable 48. Any type of fastener arrangement that retains the cable end 58 connected to the anchor may be used. Illustrated is a lug 56 having a longitudinal circular opening therethrough. In this embodiment, an enlargement 62 on the end 58 of the cable 48 prevents the cable end 58 from being pulled through the lug 56 such that when a pulling force is applied to the free end of the cable, the cable 48 is fixedly connected at the lug 56.

For use of the anchor 10 on sea bottoms that are not rocky, the cable 48 is fixed at the lug 56, threaded along the convex edge 49 of the shank 12 and engaged by the leaf 52 of the constraining guide 50. From there, the cable wraps around one side of the shank 12, i.e., the side of the shank that is opposite to the opening provided by the leaf 52, and then threads through the opening 46 of the circular guide 44 at the front end 16 of the shank 12.

A steel cable 48 is preferred at the anchor end. The cable 48 should extend from the anchor 10 at which point it may be joined to a link chain or a rope (not shown), or combinations thereof. Generically, for this application, the line between an anchor and the vessel or boat is a "rode".

Figure 1:
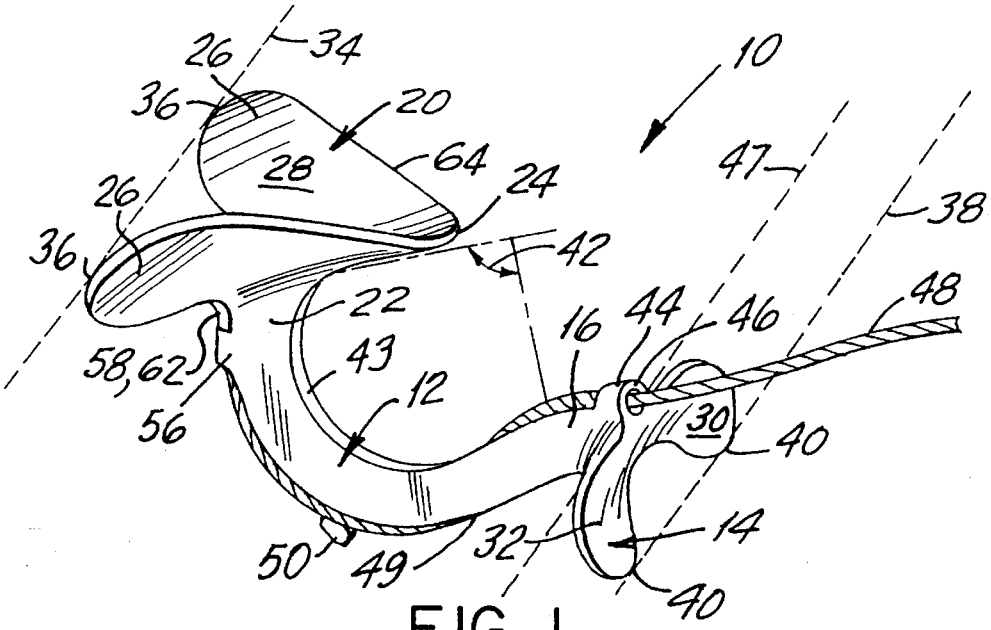
FIG. 1 is a top perspective view of an anchor in accordance with the invention.
Figure 2A:
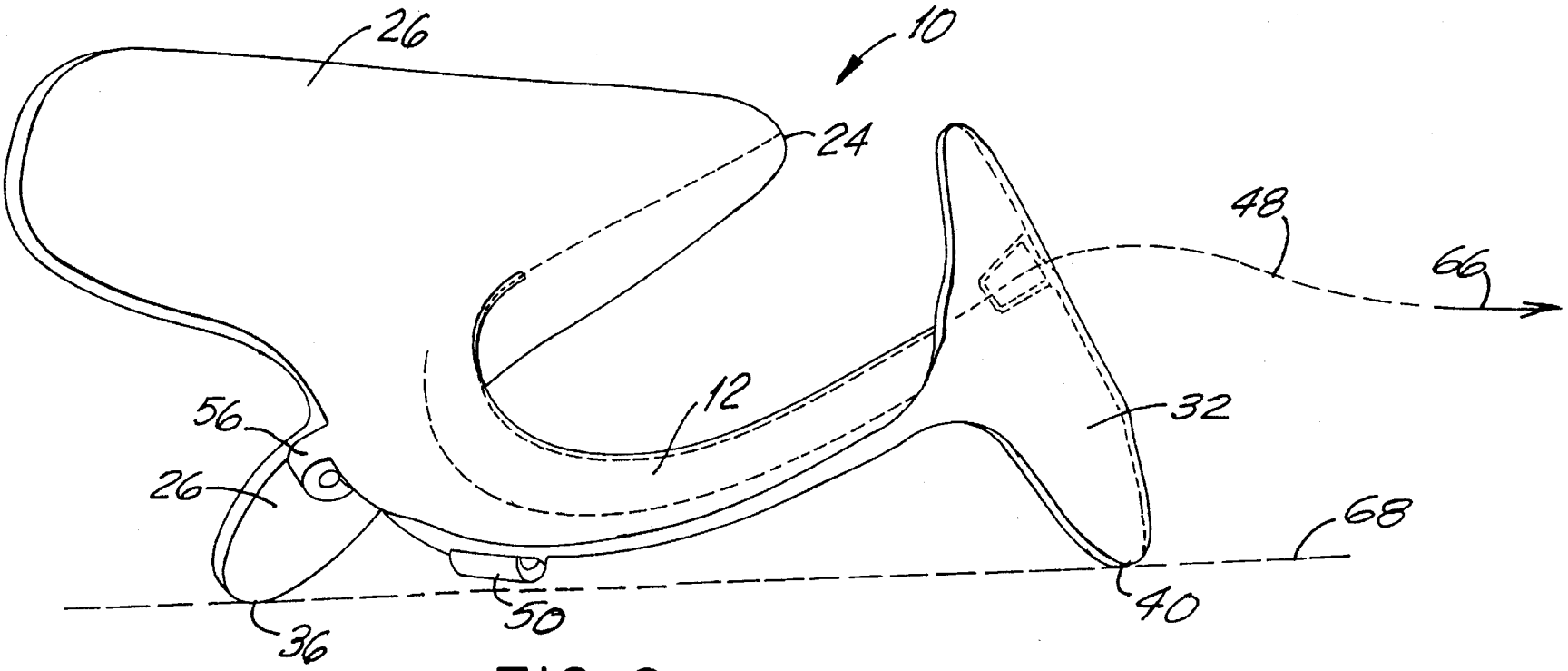
FIG. 2*a* is a front elevational view of the anchor of FIG. 1, in a position when dropped to the sea bottom.
Figure 2B:
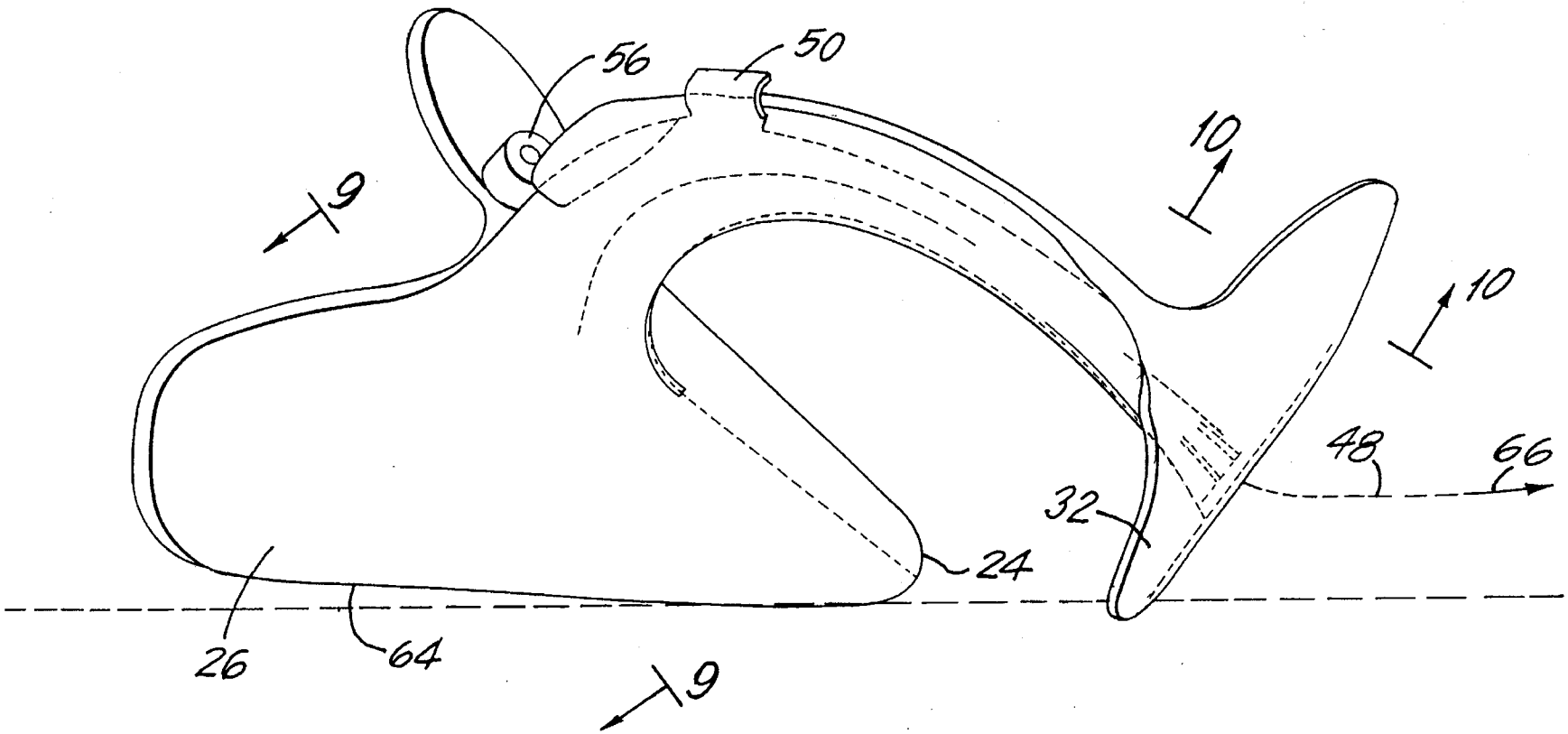
FIG. 2*b* is a view of the anchor of FIG. 1 in a second position on the sea bottom after the anchor is dropped.

On a sea bed that is penetrable, the anchor 10, which is connected by a cable as in FIG. 1, is dropped overboard and falls rapidly to the bottom 68 without significant drift. The anchor 10 comes to rest most frequently as illustrated in FIG. 2*a*, i.e., lying with bottom contact at the extremity 36 of a rear fluke lobe 26 and at an extremity 40 of a front ear lobe 32. Alternatively, the anchor is likely to fall as illustrated in FIG. 2*b* with one long edge 64 of a fluke lobe 26 resting against the bottom 68. A single ear lobe 32 is also in contact with the bottom.

Figure 3:
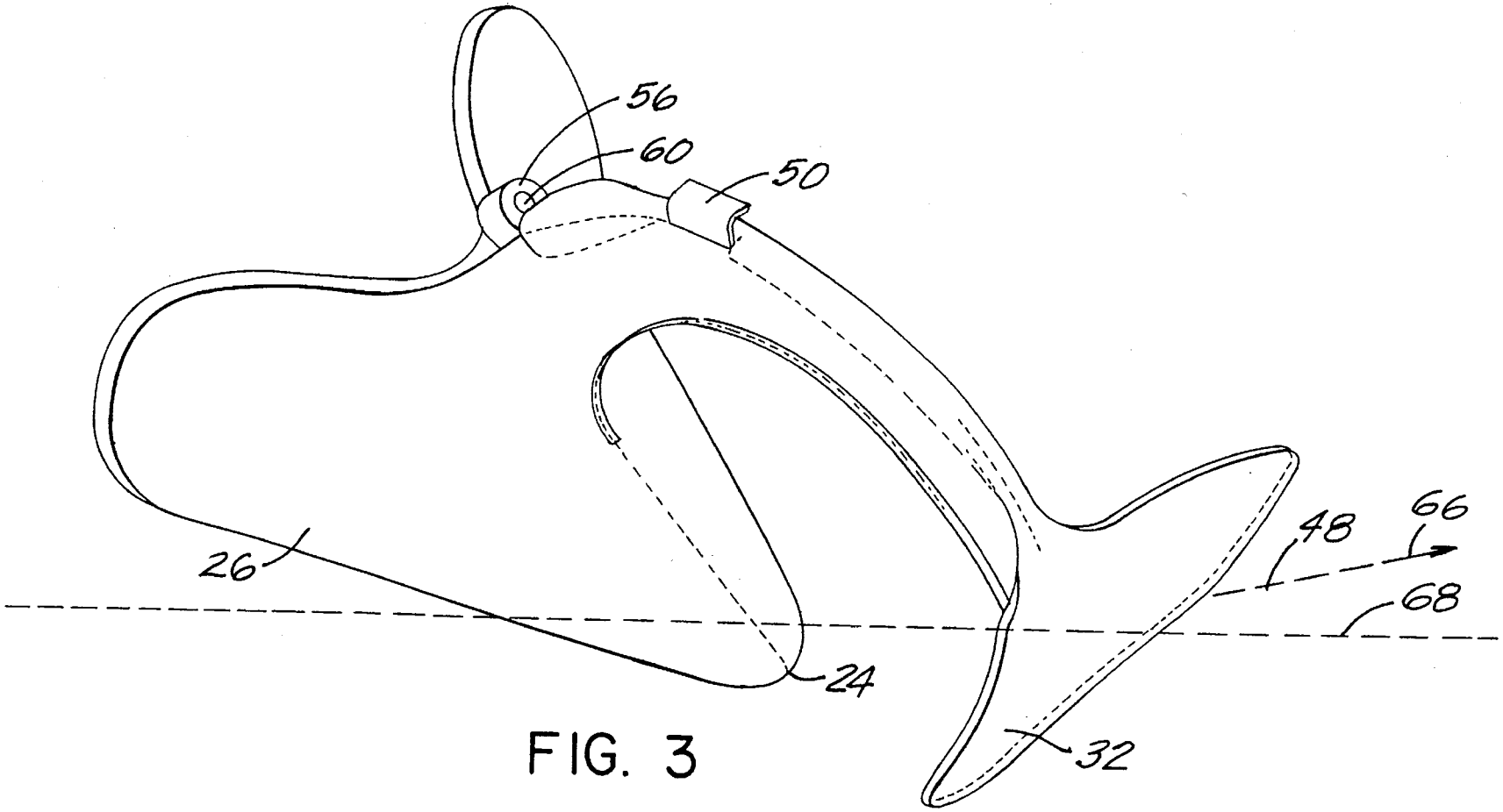
FIG. 3 is a position of the anchor after it has been dragged along a sandy bottom from the position shown in FIG. 2*b;*
Figure 4:
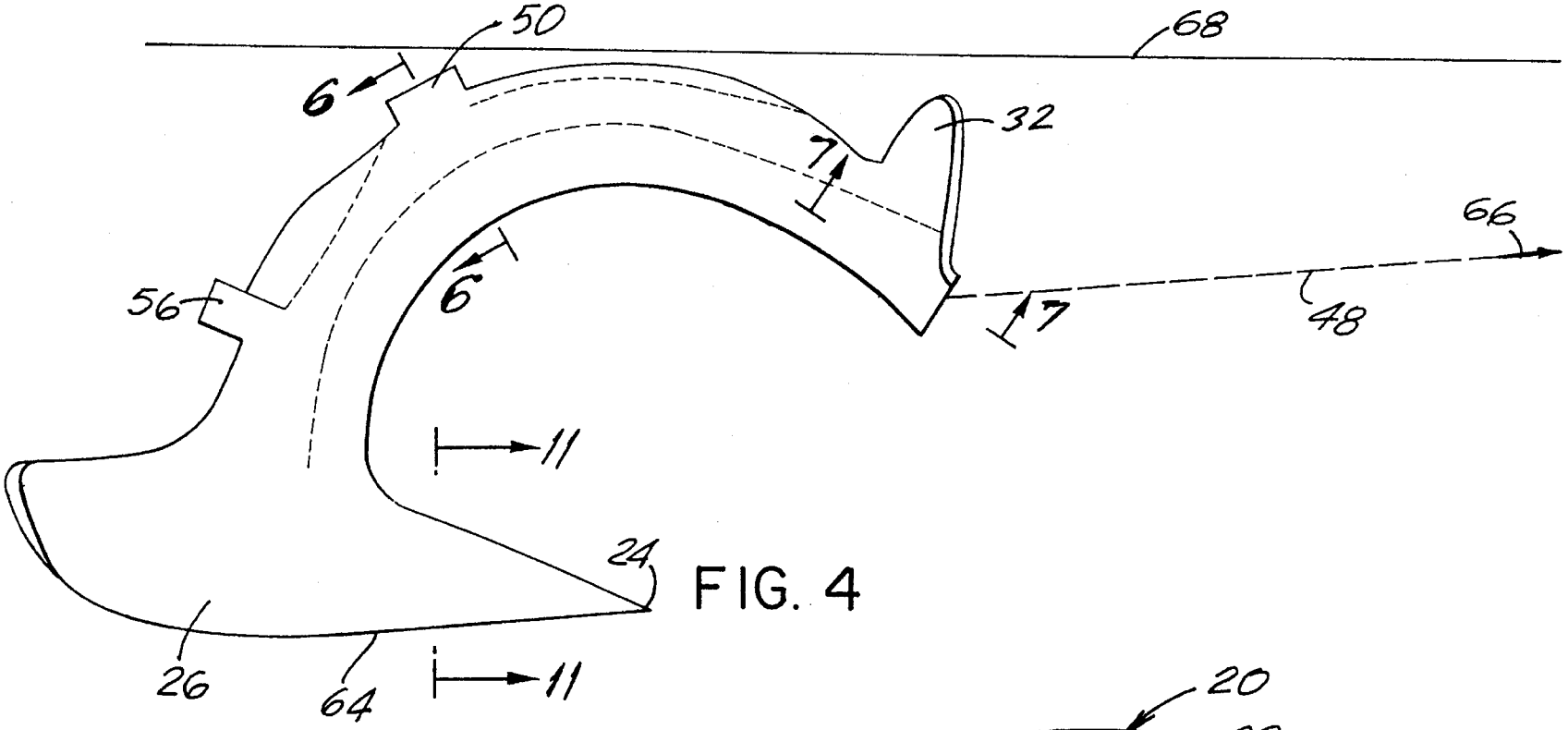
FIG. 4 is an illustration of the anchor after it has been further dragged from the position of FIG. 3.

When the anchor in the position of FIG. 2*a* is dragged by the cable 48 in the direction indicated by the force arrow 66, the ear lobe 32 in contact with the bottom 68 begins to dig into the bottom, e.g., gravel, sand, clay, mud. Due to its large working area and paddle shape, the ear lobe provides an increasingly large resistance to dragging on the bottom surface. As the force 66 continues, the anchor 10 pivots about the partially embedded ear lobe and rolls over into the position shown in FIG. 2*b*. Further pulling on the anchor 10, causes the ear lobe 32 in contact with the bottom 68 to dig further into the bottom while at the same time the rounded point 24 of the plow flukes 20 digs into the sea bottom (FIG. 3). In a short distance of continued pulling, the anchor 10 completely submerges (FIG. 4) below the surface 68 of the bottom, and the boat (not shown) is securely held. The one-sided positioning of the working surface 30 on the ears 14 relative to the centerline 47 is an important factor in the ability of the anchor to quickly grip the bottom, orient itself, and dig in when it is pulled by the cable.

The cable 48 is omitted for sake of simplicity in FIGS. 2*a*, 2*b*, 3 and 4. The cable 48 is attached and positioned as in FIG. 1.

When it is desired to raise the anchor, pulling on the cable 48 from above at a high slope brings the boat more directly over the anchor 10. The ears 14 pull up through the surface 68 first and are shortly thereafter followed by the plow flukes 20.

When the anchor in the positions 2a,b is dragged, because the circular guide 44 is not constraining in the longitudinal direction, the pulling force 66 is applied primarily to the lug 56 at the rear end of the shank 12 and to the intermediate constraining guide 50. Thus, the shank between the front end 16 and the constraining guide 50 is only lightly loaded, not subject to bending, as compared to direct attachment of the cable to the free end (front) of a shank as in the prior art. Accordingly, the front portion of the shank 12 can be made thinner and lighter than the corresponding portion of the shank in anchors of the prior art where the cable, chain or rope attaches directly at the front end of the anchor.

Wrapping of the cable 48 around the shank 12 further distributes the load in the shank and reduces the stress in the leaf 52 and at the lug 56.

Figure 5:
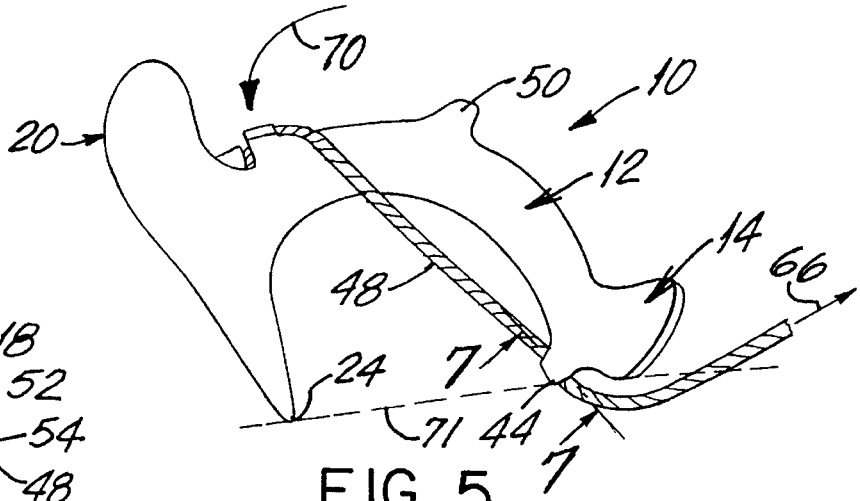
FIG. 5 is a side view of the anchor of FIG. 1 showing an alternative arrangement of a cable in accordance with the invention.

When dropping anchor over a sea bed that is rocky, the cable 48 may be released from the intermediate constraining guide 50, as illustrated in FIG. 5. Pulling on the cable 48 by the boat creates a turning moment 70 about the ears 14 that causes the rounded point 24 of the plow flukes 20 to further engage the rocky surface. In raising the anchor, release is easily effected as the anchor can pivot about the rounded point 24 and also can rotate about an axis 71 that extends generally longitudinally of the anchor 10 from the rounded point 24 to the circular guide 44 and ears 14. In this way the arcuate shape of the shank 12 aids in release from rocky sea beds without damage to the shank.

With reference to the cable/anchor arrangement of FIG. 5, for rocky bottoms, the anchor need not have ears 14. Such an earless anchor will not have the same effectiveness in attaching quickly to flat sandy bottoms as described above. But for a rocky bottom, the anchor can have a lighter shank construction than a conventional anchor that has its cable attached at the front end of the shank. The anchor in accordance with the invention, without ears but with rear cable attachment at the lug 56, and through the guide 44, will have greater holding power on a rocky bottom for its weight than an anchor conventionally attached at its front end.

Also, in further alternative embodiments in accordance with the invention, the holding lug, that is the point where the cable is fixed in use and applies its pulling load to the shank, whether or not ears are included on the shank, need not be at the flukes (as illustrated) but may be spaced on the shank away from the flukes. Only the portion of the shank between the attachment point and the flukes must then be dimensioned to take the full pulling forces.

An anchor 10 with flukes and ears that is intended for use primarily on sandy type bottoms may also have the cable attached at the front end of the shank near the ears. The working surface 30 of the ears enhances rapid attachment of the anchor 10 and improves its holding power, as compared to conventional anchors without ears.

In summary, attachment of the cable at the rear end of the shank, and along the shank, has its major advantage on rocky bottoms. The ears have their major advantage on penetrable sandy, muddy, clay, etc bottoms. The illustrated embodiment includes the features for excellent performance on all types of sea beds.

Figure 8:
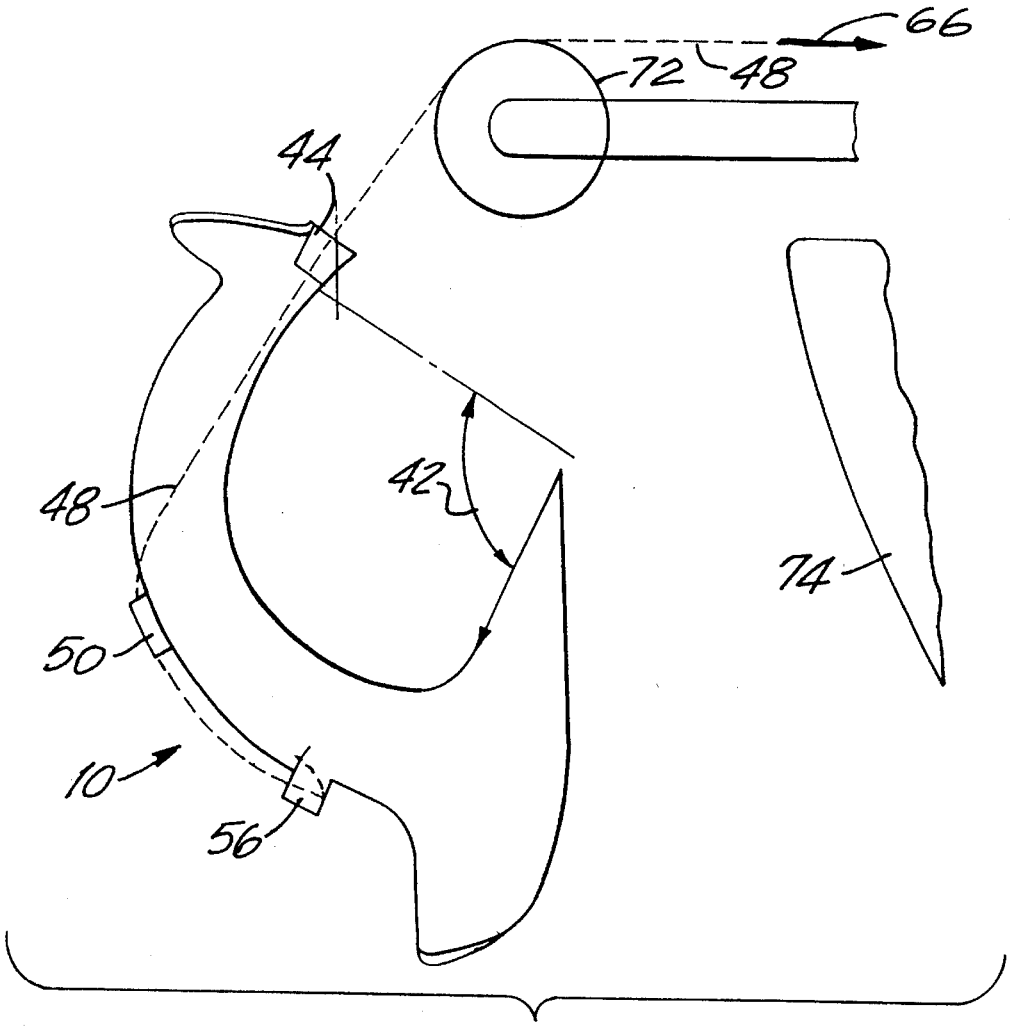
FIG. 8 is a side view of the anchor suspended by its cable from a roller at the bow of a vessel.

When the anchor 10 is raised to the bow of a boat using anchor rollers 72 in the known manner, the anchor 10 automatically turns on the cable 48 so that the bow 74 of the boat may be cradled in the V-shaped concavity of the surface 28 between the plow fluke lobes 26 at the rear end of the anchor. This automatic orientation of the anchor is believed to be the result of any one, or a combination, of the following physical effects. First, a steel cable 48 provides a turning effect on the anchor as the cable is drawn over the anchor rollers 72, especially when the anchor comes close to the rollers. Further, the steel cable acts somewhat as a bent spring that tries to raise and pivot the plow flukes 20 relative to the ear end 16 of the anchor 10. This spring action raises the center of gravity of the cable/anchor assembly and with any force imbalance, the anchor rotates to bring the center of gravity to the lowest energy position. Additionally, as the pulling force raises the anchor, the entrance to the circular guide 44 moves as close as possible, when the ears are not blocked, to the source of the cable, i.e., the rollers 72. The closest position is with the anchor oriented as illustrated in FIG. 8 with the plow flukes located so as to cradle the bow. The angle of entry of the cable 48 into the guide opening 46 (FIGS. 7, 8) also appears to be an important factor in automatic orientation of the suspended anchor. A non-vertical orientation of the through axis of the guide opening 46 as the anchor is lifted vertically by the cable is desirable.

Figure 10:
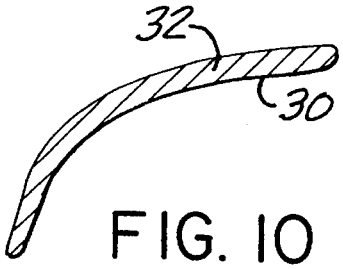
* and FIG. 10 is a sectional view taken along the line 10—10 of FIG. 2*b*.

FIGS. 9, 10 and 11 illustrate cross-sections of the flukes and ears. It should be understood that in alternative embodiments in accordance with the invention, the flukes and ears may have planar surfaces on other contours. The imaginary lines 34, 38 (FIG. 1) between the extremities 36, 40 of the plow flukes and ears need not be parallel. Also, the shape of the plow flukes need not be heart-shaped and V-shaped as described. However, the end of the flukes facing the cable is preferably generally pointed to enhance engagement with a sandy or rocky bottom, and to provide quick burial in a non-rocky bottom. Also, in alternative embodiments in accordance with the invention the ears may have a surface area equal to or greater than the surface area of the plow flukes.

Also, the shank may extend through one or both of the flukes and ears into the "valley" created by the lobes.

Additionally, the attachment point for the cable may include, e.g., a hole made transversely through the thickness of the shank 12 in place of the lug 56. Also, the attachment may be set off from the shank on a pod (not shown). It is the location of the attachment away from the front end of shank 12 that is a novel feature of the invention. Similarly, the guide 44 may be set off from or through the shank. The position near or on the ears and the physical relationship to the attachment lug and flukes are novel features of the invention. The constraining guide 50 may also be subject to alternative positionings between the ends of the shank, in accordance with the invention.

The arc between the ears and the flukes has been described as enclosing an angle 42 of 90 degrees. It should be understood that the shank need not be arcuate but may be made of a plurality of straight segments or any combination of straight and curved segments. The shank between the ears and the flukes may be one straight continuous element. Thus, the connecting shank between the ears and the flukes may subtend an angle 42 between zero and 90 degrees and even greater than 90 degrees. The angle 42 and the distances between the flukes and the ears affect the orientation characteristics of the anchor 10 when first pulled over the sea bottom after the anchor is dropped.

The anchor may be fabricated of metal or plastic. Also, advanced materials using laminations, coatings, composites, fiber reinforcement, honeycomb, and the like may be utilized as are suitable for the water environment and the working loads.

All such constructions are intended to fall within the spirit and scope of the invention. The anchor in accordance with the invention, having both rear plow flukes and front ears has greater holding power, smaller size, and by applying the pulling force closer to the fluked rear end, even without ears, is less subject to damage when compared to other anchor types of similar weight.

It will thus be seen that the objects set forth above, and those made apparent from the preceding description, are efficiently attained and, since certain changes may be made in the above constructions without departing from the spirit or the scope of the invention, it is intended that all matter contained in the above description and shown in the accompanying drawings shall be interpreted as illustrative and not in a limiting sense.

I claim:

1. A boat anchor for holding on all sea beds, comprising:

a shank of extended length;

ears extending transversely from said shank, said ears including a pair of ear lobes extending respectively from opposite sides of said shank;

plow flukes extending transversely from said shank, said flukes including a pair of fluke lobes extending respectively from opposite sides of said shank, said flukes and said ears being spaced apart along said shank length, said shank length including a fixed bend between said ears and said flukes;

attachment means on said anchor for connection to a rode.

2. An anchor as in claim 1, wherein said attachment means is located closer to said flukes than to said ears.

3. An anchor as in claim 2, wherein said attachment means is located on said shank.

4. An anchor as in claim 1, wherein said attachment means is located on said shank.

5. An anchor as in claim 4, further comprising guide means located closer to said ears than to said flukes, said guide means including an opening for extending said rode therethrough in use of said anchor, said opening being dimensioned to provide one of a running and sliding fit for said rode.

6. An anchor as in claim 5, wherein said guide means is proximate said ears.

7. An anchor as in claim 6, wherein said guide means is located on said shank.

8. An anchor as in claim 3, further comprising guide means located closer to said ears than to said flukes, said guide means being on said shank and including an opening for extending said rode therethrough in use of said anchor, said opening being dimensioned to provide one of a running and sliding fit for said rode.

9. An anchor as in claim 7, further comprising constraint means on said shank for releasibly retaining said rode in use of said anchor.

10. An anchor as in claim 9, wherein said shank has a cross-section with a concave edge and a convex edge, said attachment means and said constraint means being proximate one said edge, said guide means being proximate the other said edge.

11. An anchor as in claim 10, wherein said one edge is said convex edge and said other edge is said concave edge, said rode, being partially wrapped around said shank cross-section for extending from said constraining means to said guide means.

12. An anchor as in claim 9, further comprising a cable positioned at said attachment means, said cable being constrained by said constraint means, guided in said opening of said guide means, and partially wrapped around said shank between said constraint means and said guide means.

13. An anchor as in claim 6, further comprising a cable positioned at said attachment means, said cable being guided in said opening of said guide means.

14. An anchor as in claim 6, wherein said shank has a cross-section with a concave edge and a convex edge, said attachment means being proximate one said edge, said guide means being proximate the other said edge.

15. An anchor as in claim 1, wherein said fluke lobes are connected to form a heart-shape having a generally pointed end, said pointed end narrowing toward said ears.

16. An anchor as in claim 15, wherein said heart-shape has generally a V-shape in cross-section, a concave surface of said V-shape opening away from said ears.

17. An anchor as in claim 1, wherein said ear lobes are connected to form said ears having a concave surface between extremities of said ear lobes, said concave surface opening away from said flukes.

18. An anchor as in claim 16, wherein said ear lobes are connected to form said ears, said ears having a concave working surface between extremities of said ear lobes, said concave surface opening away from said flukes.

19. An anchor as in claim 18, wherein said concave surface of said heart-shape is greater in the area than said concave surface of said ear lobes.

20. An anchor as in claim 8, further comprising constraint means on said shank for releasibly retaining said rode in use of said anchor.

21. An anchor as in claim 20, wherein said shank has a cross-section with a first edge and a second edge, said attachment means and said constraint means being proximate said first edge, said guide means being proximate said second edge, said rode, in use, resting against a side surface of said shank cross-section between said edges and extending from said attachment means to said guide means.

22. An anchor as in claim 1, wherein said bend includes an angle of approximately 90 degrees.

23. An anchor as in claim 3, wherein said ears are at one end of said shank and said flukes are at the other end of said shank.

24. An anchor as in claim 6, wherein said ears are at one end of said shank and said flukes are at the other end of said shank.

25. An anchor as in claim 9, wherein said ears are at one end of said shank and said flukes are at the other end of said shank.

26. An anchor as in claim 6, wherein said bend includes an angle of approximately 90 degrees.

27. An anchor as in claim 9, wherein said bend includes an angle of approximately 90 degrees.

28. An anchor as in claim 5, wherein said opening in said guide means has a flared edge.

29. A boat anchor for holding on all sea beds, comprising:

a shank of extended length having a bend between a first end and a second end, and said shank having a concave edge and a convex edge;

ears extending transversely from said first end of said shank, said ears including a pair of ear lobes extending respectively from opposite sides of said shank, said ear lobes being connected to form a first working surface between extremities of said ear lobes;

plow flukes extending transversely from said shank at said second end, said flukes including a pair of fluke lobes extending respectively from opposite sides of said shank, said fluke lobes being connected to form a second working surface having a generally pointed end, said pointed end narrowing toward said ears;

attachment means on said convex edge of said shank for connection to an anchor rode; and guide means located on said concave edge of said shank at said first end, said guide means including an opening for extending said rode therethrough in use of said anchor, said opening being dimensioned to provide one of a running and sliding fit for said rode.

30. An anchor as in claim 29, further comprising constraint means on said shank between said attachment means and said guide means for releasibly retaining said rode in use of said anchor, said constraint means being on said convex edge of said shank.

31. An anchor as in claim 29, wherein said first working surface of said ear lobes is on one side of an axis of said guide means opening.

32. An anchor as in claim 29, wherein said first working surface of said ear lobes is concave and opening away from said second end of said shank, and said second working surface of said flukes is heart-shaped, and having a generally V-shaped cross section, said cross section opening away from said ears.

33. A boat anchor for holding on all sea beds, comprising:

a shank of extended length;

ears extending transversely from said shank, said ears including a pair of ear lobes extending respectively from opposite sides of said shank;

plow flukes extending transversely from said shank, said flukes including a pair of fluke lobes extending respectively from opposite sides of said shank, said flukes and said ears being spaced apart along said shank length, said shank length including a bend between said ears and said flukes;

attachment means on said shank for connection to a rode;

guide means located closer to said ears than to said flukes, said guide means including an opening for extending said rode therethrough in use of said anchor, said opening being dimensioned to provide one of a running and sliding fit for said rode, said ear lobes being connected to form a working surface for engaging said sea beds, said working surface being on one side of an axis of said guide means opening.

34. An boat anchor for holding on all sea beds, comprising:

a shank of extended length;

ears extending transversely in opposite directions from said shank;

flukes extending transversely in opposite directions from said shank, said flukes and ears being spaced apart along said shank length, said shank length including a bend between said ears and said flukes;

guide means connected to said shank and located closer to said ears than to said flukes, said guide means including an opening for extending a rode therethrough in use of said anchor, said opening having a centerline, said ears having a working surface for engaging said sea bed, said working surface being substantially on one side of said centerline, said flukes being substantially on the opposite side of said centerline.

* * * * *